US007077506B2

(12) United States Patent
Chen

(10) Patent No.: US 7,077,506 B2
(45) Date of Patent: Jul. 18, 2006

(54) IDENTIFIABLE INKJET CARTRIDGE AND METHOD OF PREVENTING MISPLACING INKJET CARTRIDGE IN AN INKJET APPARATUS

(75) Inventor: Chih-Ching Chen, Taipei (TW)

(73) Assignee: BenQ Corporation, Tao-Yuan Hsien (TW)

( * ) Notice: Subject to any disclaimer, the term of this patent is extended or adjusted under 35 U.S.C. 154(b) by 182 days.

(21) Appl. No.: 10/708,460

(22) Filed: Mar. 5, 2004

(65) Prior Publication Data

US 2004/0165041 A1 Aug. 26, 2004

Related U.S. Application Data

(63) Continuation-in-part of application No. 10/253,545, filed on Sep. 25, 2002, now abandoned, and a continuation-in-part of application No. 10/253,544, filed on Sep. 25, 2002, now Pat. No. 6,860,592, and a continuation-in-part of application No. 10/253,543, filed on Sep. 25, 2002, now Pat. No. 6,805,430, and a continuation-in-part of application No. 10/064,631, filed on Aug. 1, 2002, now Pat. No. 6,712,457.

(51) Int. Cl.
*B41J 2/14* (2006.01)

(52) U.S. Cl. ..... 347/50

(58) Field of Classification Search ..... 347/19, 347/37, 43, 49, 50, 58, 86, 87
See application file for complete search history.

(56) References Cited

U.S. PATENT DOCUMENTS 4,907,018 A * 3/1990 Pinkerpell et al. ..... 346/139 R
5,442,386 A * 8/1995 Childers et al. ..... 347/50
5,519,422 A 5/1996 Thoman et al.
5,748,209 A 5/1998 Chapman et al.
5,969,738 A 10/1999 Tomikawa et al.
5,975,688 A 11/1999 Kanaya et al.
5,984,464 A * 11/1999 Steinfield et al. ..... 347/87
6,151,046 A 11/2000 Abe et al.
6,161,915 A 12/2000 Bolash et al.
6,334,660 B1 1/2002 Holstun et al.
6,409,312 B1 6/2002 Mrvos et al.
6,431,686 B1 8/2002 Saul et al.
6,467,869 B1 10/2002 Merz et al.
6,585,347 B1 7/2003 Johnson et al.
6,712,457 B1 3/2004 Chen et al.
6,735,865 B1 5/2004 Leu et al.
6,805,430 B1 * 10/2004 Chen et al. ..... 347/43
6,860,592 B1 * 3/2005 Chen et al. ..... 347/86
2003/0058311 A1 3/2003 Chen et al.

FOREIGN PATENT DOCUMENTS

| | | |
|---|---|---|
| DE | 199 54 750 A1 | 5/1990 |
| DE | 4240141 | 6/1994 |
| EP | 0157374 | 10/1985 |
| EP | 1 114 726 A1 | 7/1999 |
| JP | 04-340295 | 11/1992 |
| JP | 2000-208898 | 7/2000 |

* cited by examiner

*Primary Examiner*—Anh T. N. Vo
(74) *Attorney, Agent, or Firm*—Winston Hsu

(57) ABSTRACT

An identifiable TAB for an inkjet cartridge. The identifiable tab contains a flexible substrate, a plurality of conductive traces formed on the flexible substrate, and a plurality of contacts formed on the flexible substrate and connected to the conductive traces. The contacts of the identifiable TAB are arranged into at least one identifiable area for aiding in identifying the inkjet cartridge.

16 Claims, 9 Drawing Sheets

IDENTIFIABLE INKJET CARTRIDGE AND METHOD OF PREVENTING MISPLACING INKJET CARTRIDGE IN AN INKJET APPARATUS

CROSS REFERENCE TO RELATED APPLICATIONS

This application is a continuation-in-part of U.S. application Ser. No. 10/253,545 filed Sep. 25, 2002, U.S. application Ser. No. 10/253,544 filed Sep. 25, 2002 now U.S. Pat. No. 6,860,592, Ser. No. 10/253,543 filed Sep. 25, 2002 now U.S. pat. No. 6,805,430, application Ser. No. 10/064,631 filed Aug. 1, 2002 now U.S Pat. No. 6,712, 457. All of the above-mentioned applications are included in their entirety herein by reference.

BACKGROUND OF INVENTION

1. Field of the Invention

The present invention relates to an inkjet apparatus, and more particularly to inkjet cartridges with an identifiable area and a method of preventing misplacing the inkjet cartridges in the inkjet apparatus.

2. Description of the Prior Art

The inkjet apparatus, such as a copy machine, facsimile machine, or inkjet printer, has become a necessity in modern life. The inkjet printer mainly includes a housing and a printing module situated inside the housing to perform the printing steps. The details of the printing module are described as follows.

Please refer to FIG. 1 and FIG. 2. FIG. 1 is a perspective view of an inkjet apparatus 10 having printhead cartridges 114*a* and 114*b* installed. FIG. 2 is a schematic drawing of a conventional printing module 100 in the inkjet apparatus 10. The printing module 100 includes a carriage 102, a rod 104, a print platform 106 and sidewalls 108*a* and 108*b*. The sidewalls 108*a* and 108*b* are set oppositely, and two ends of the rod 104 are respectively connected to the sidewalls 108*a* and 108*b*. The carriage 102, removably arranged on the rod 104, can move forward or backward over the print platform 106 along the direction of arrow 105, to accomplish the printing operation. The carriage 102 comprises the printed circuit boards (PCBs) 110*a* and 110*b*, and cartridge-setting slots 112*a* and 112*b* for placing the inkjet cartridges 114*a* and 114*b* therein. Also, there are flexible PCBs 116*a* and 116*b* attached at surfaces 115*a* and 115*b* of the inkjet cartridges 114*a* and 114*b*, respectively. When the inkjet cartridges 114*a* and 114*b* are respectively put into the cartridge-setting slots 112*a* and 112*b*, the flexible PCBs 116*a* and 116*b* electrically couple to the PCBs 110*a* and 110*b* at the carriage 102. Therefore, current conducted into the flexible PCBs 116*a* and 116*b* through the PCBs 110*a* and 110*b* and the inkjet apparatus 10 controls the movement of the carriage 102 and drives the inkjet cartridges 114*a* and 114*b* to eject ink.

Generally, two inkjet cartridges are adapted in a printing module 100. One is a single-color cartridge 114*b*, usually filled with black ink. The other is a color cartridge 114*a*, having separated ink reservoirs and filled with different color inks such as cyan, magenta, and yellow ink. In the commercial inkjet printer market, there are other colors of ink to be used, such as light black, light cyan, light magenta, and light yellow. In addition, a photo cartridge can also be used in combination with a color cartridge for printing high quality photographs.

However, the similar external appearances of the conventional homochromatic cartridge and the color cartridge confuse the user all the time. Consequently, the misplacement of cartridges in the carriage 102 occurs, which negatively affects the printing result. In order to put the homochromatic cartridge 114*b* and the color cartridge 114*a* into the correct positions in the carriage 102, which means that the flexible PCBs 116*a* and 116*b* are respectively electrically coupled to the PCBs 110*a* and 110*b*, some manufacturers try to create a difference in the cartridges 114*a* and 114*b*. For example, a different size can be used for each of the cartridges 114*a* and 114*b*. As shown in FIG. 2, the size of the cartridge 114*a* is larger than that of the cartridge 114*b*; correspondingly, the space of cartridge setting slot 112*a* is larger than that of the cartridge setting slot 112*b*. The inkjet cartridge can only be installed in the size-matched cartridge setting slot. Accordingly, the misplacement of cartridges can be prevented.

Also, some manufacturers make an improvement in the configuration of the cartridge, so that the user can visually distinguish the cartridge model and its matched cartridge setting slot. However, the cartridges are usually mass-produced. Changing the configuration of the cartridge will raise the production cost.

SUMMARY OF INVENTION

It is therefore an object of the claimed invention to provide an identifiable tape automated bonding (TAB) device disposed on an inkjet cartridge and a method of preventing misplacing inkjet cartridges in an inkjet apparatus in order to solve the above-mentioned problems.

According to the claimed invention, an identifiable TAB is disposed on an inkjet cartridge. The identifiable tab contains a flexible substrate, a plurality of conductive traces formed on the flexible substrate, and a plurality of contacts formed on the flexible substrate and connected to the conductive traces. The contacts of the identifiable TAB are arranged into at least one identifiable area for aiding in identifying the inkjet cartridge.

According to the claimed invention, a method of preventing misplacing inkjet cartridge that is adapted for an inkjet apparatus is disclosed. The inkjet apparatus includes a carriage equipped with a first inkjet cartridge and a second inkjet cartridge. The first inkjet cartridge and the second inkjet cartridge respectively have a first plurality of contacts and a second plurality of contacts. The first contacts and the second contacts are arranged into a first identifiable area and a second identifiable area, and the first identifiable area and the second identifiable area are associated with the colors of ink stored in the first inkjet cartridge and the second inkjet cartridge. The method includes detecting the first identifiable area and the second identifiable area, sending a first signal and a second signal, receiving the first signal and the second signal, and determining whether the first inkjet cartridge and the second inkjet cartridge are correctly placed.

It is an advantage of the claimed invention that by viewing the identifiable TAB, the user of the inkjet apparatus can easily distinguish between the different types of inkjet cartridges. Moreover, if the user accidentally inserts the inkjet cartridge into the wrong slot in the inkjet apparatus, the inkjet apparatus can alert the user to the misplaced condition.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
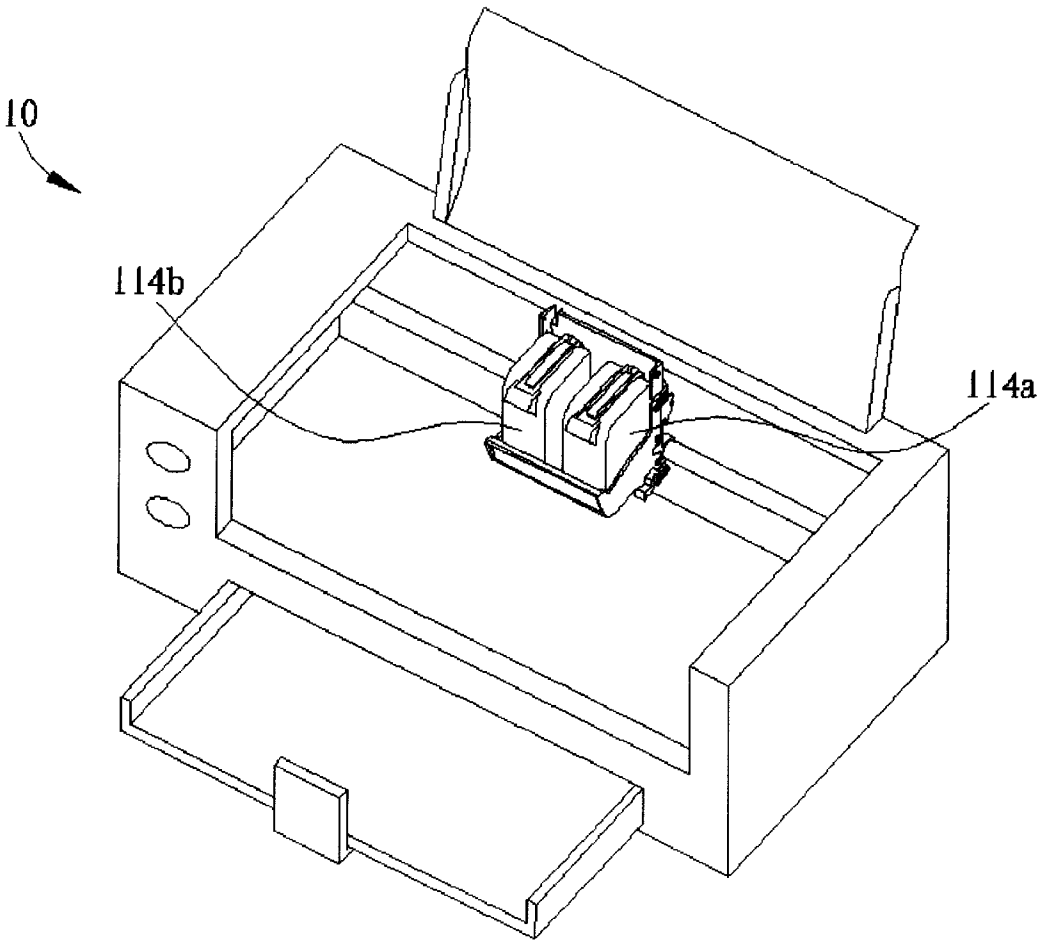
Fig. 1 Prior art
FIG. 1 is a perspective view of an inkjet apparatus having printhead cartridges installed.
Figure 2:
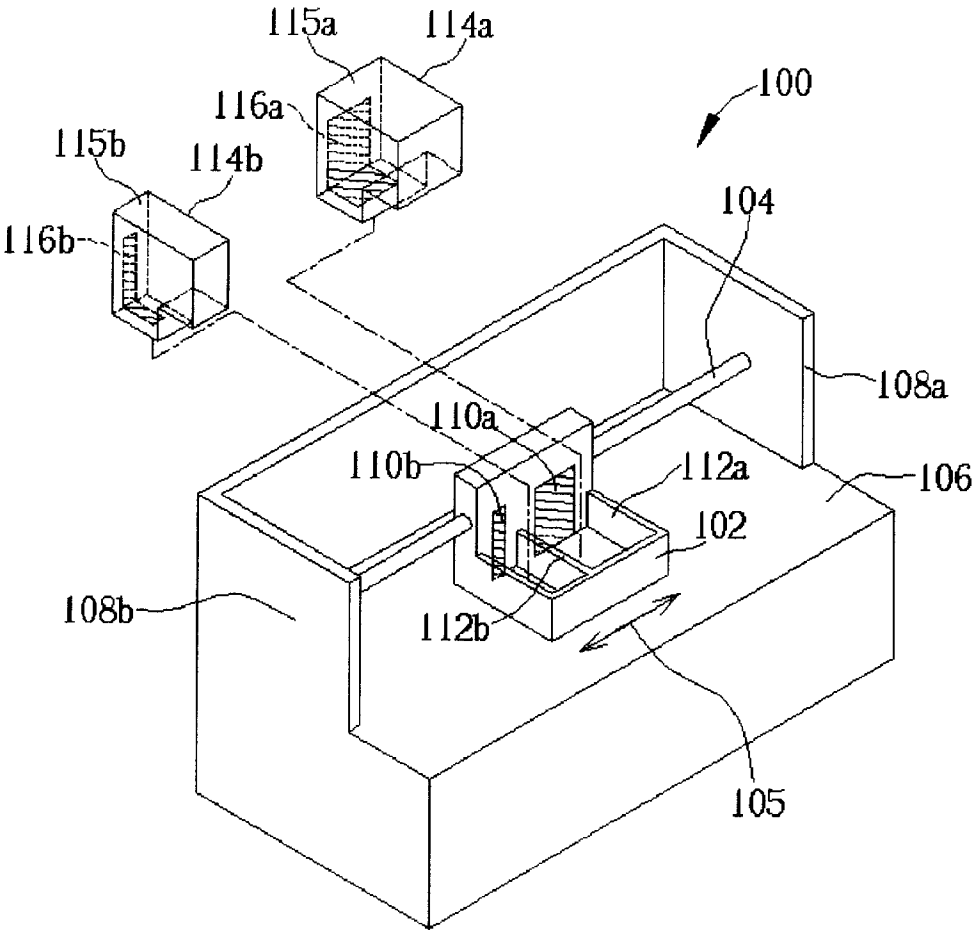
Fig. 2 Prior art
FIG. 2 is a schematic drawing of a conventional printing module in the inkjet apparatus.
Figure 3:
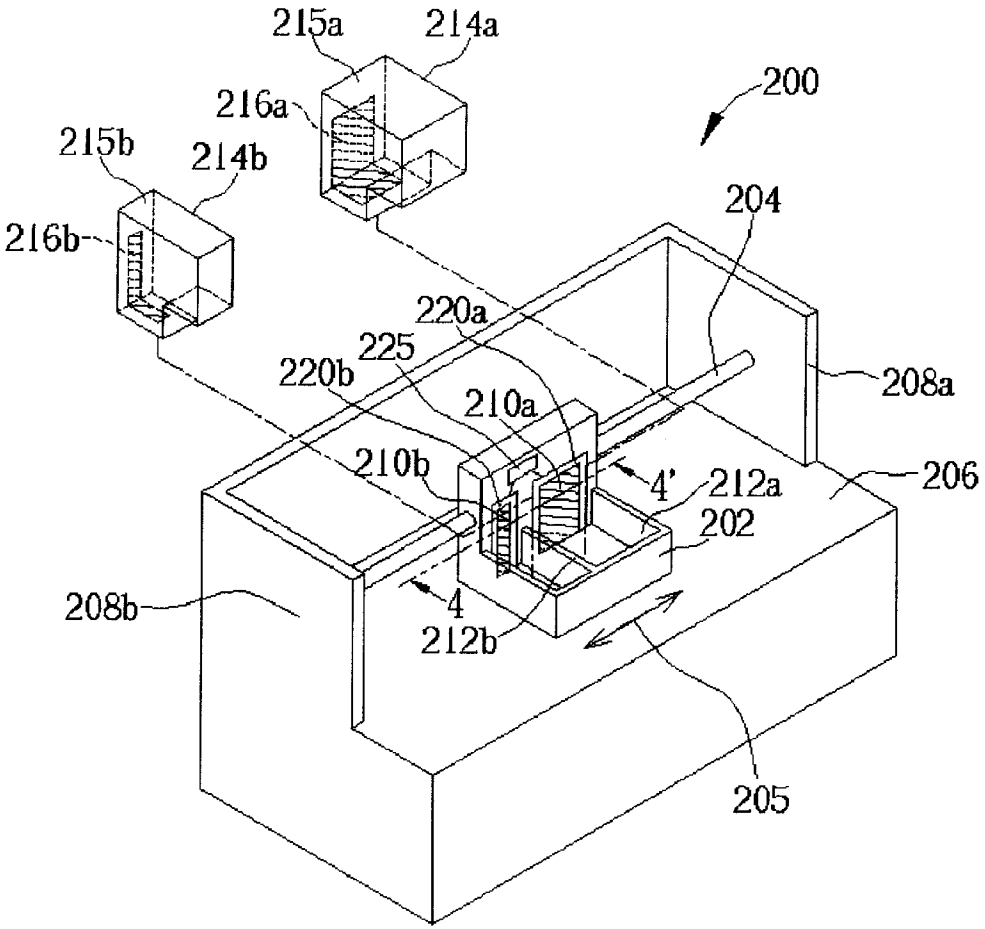
FIG. 3 is a schematic drawing of a printing module in the inkjet apparatus according to the preferred embodiment of the invention.

Please refer to FIG. 3. FIG. 3 is a schematic drawing of a printing module 200 in the inkjet apparatus 10 according to the preferred embodiment of the invention. The printing module 200 of the present invention is an improvement of the printing module 100 of the prior art. The printing module 200, situated inside the housing of the inkjet apparatus 10, includes a carriage 202, a rod 204, a print platform 206 and sidewalls 208*a* and 208*b*. The sidewalls 208*a* and 208*b* are set oppositely, and two ends of the rod 204 are respectively connected to the sidewalls 208*a* and 208*b*. The carriage 202, removably mounted on the rod 204, can move forward or backward over the print platform 206 along the direction of arrow 205 during printing operation. The carriage 202 comprises a control unit 225, sensors 220*a* and 220*b*, printed circuit boards (PCBs) 210*a* and 210*b*, and cartridge-setting slots 212*a* and 212*b* for receiving the inkjet cartridges 214*a* and 214*b*. Also, there are flexible PCBs 216*a* and 216*b* attached at the surfaces 215*a* and 215*b* of the inkjet cartridges 214*a* and 214*b*, respectively. Alternatively, the PCBs 210*a* and 210*b* could be designed as one integrated PCB.

When the inkjet cartridges 214*a* and 214*b* are respectively put into the cartridge-setting slots 212*a* and 212*b*, the flexible PCBs 216*a* and 216*b* could electrically couple to the PCBs 210*a* and 210*b* at the carriage 202. Therefore, current is conducted into the flexible PCBs 216*a* and 216*b* through the PCBs 210*a* and 210*b*, and the inkjet apparatus 10 controls the movement of the carriage 202 and drives the inkjet cartridges 214*a* and 214*b* to eject ink. If the user misplaces the cartridges 214*a* and 214*b* into the wrong slots (212*a* and 212*b*), the printing operation is terminated and is not performed.

In this preferred embodiment, the cartridge 214*b* is a single-color cartridge filled with black ink, while the cartridge 214*a* is a color cartridge filled with three different colors of ink such as cyan, magenta and yellow. In the practical application, the color of ink filled in the cartridge could optionally be cyan, magenta, yellow, light black, light cyan, light magenta, or light yellow. In addition, any number of cartridges can be used, and single colors or any combination of multiple colors can be used in each of the cartridges according to the present invention. For instance, four individual cartridges can be used. The four cartridges could contain the colors black, cyan, magenta, and yellow. On the other hand, two cartridges can be used each having multiple colors of ink. An example of this scenario is using a photo cartridge in conjunction with a color cartridge. The photo cartridge could have the colors light cyan, light magenta, and black. The color cartridge could have the colors cyan, magenta, and yellow.

Each of the flexible PCBs 216*a* and 216*b* contains a plurality of contacts (not shown in FIG. 3) that respectively make electrical contact with the PCBs 210*a* and 210*b* of the carriage 202. As will be described later, the contacts are arranged to form an identifiable area. The identifiable area helps users of the inkjet apparatus 10 easily identify the types of cartridges when inserting cartridges into the inkjet apparatus 10. Therefore, the user immediately knows the type of the cartridges 214*a* and 214*b* by looking at the arrangement of the contacts on the flexible PCBs 216*a* and 216*b*.

The sensors 220*a* and 220*b* are disposed on the carriage 202 to prevent the misplacement of the cartridges 214*a* and 214*b* on the carriage 202. The sensors 220*a* and 220*b* are disposed underneath the PCBs 210*a* and 210*b* and are electrically connected to the control unit 225. The sensors 220*a* and 220*b* sense the pattern of contacts on the flexible PCBs 216*a* and 216*b* of the cartridges 214*a* and 214*b*. The sensors 220*a* and 220*b* may be charged coupling devices (CCDs) or contact image sensors (CISs). The sensors 220*a* and 220*b* then send first and second signals to the control unit 225, and the control unit 225 determines the type of cartridges placed in the cartridge-setting slots 212*a* and 212*b* of the carriage 202. The sensors 220*a* and 220*b* can send the first and second signals to the control unit 225 wirelessly or through wires connecting the sensors 220*a* and 220*b* to the control unit 225.

Figure 4:
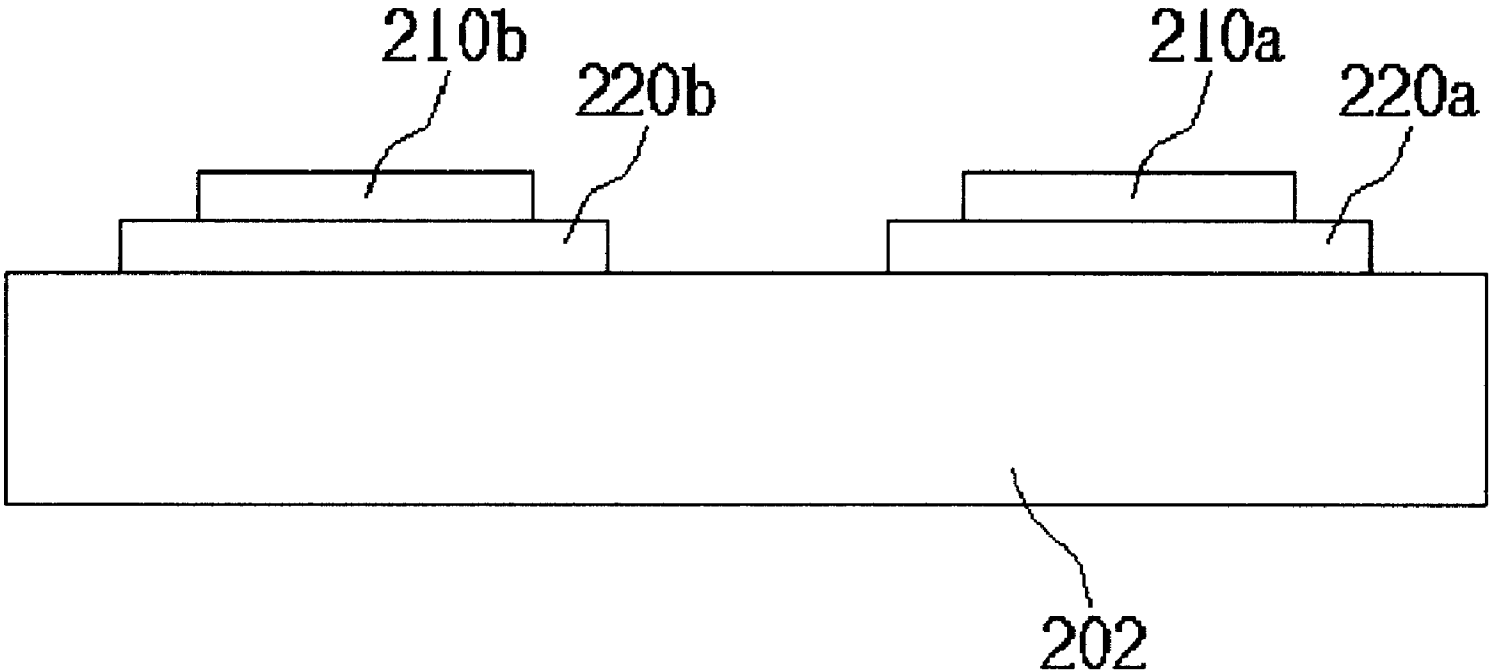
FIG. 4 is a cross-sectional diagram drawn along line 4-4" of FIG. 3.

Please refer to FIG. 4. FIG. 4 is a cross-sectional diagram drawn along line 4-4" of FIG. 3. Each of the sensors 220*a* and 220*b* is disposed on the carriage 202. Next, the PCBs 210*a* and 210*b* are respectively disposed on the sensors 220*a* and 220*b*. The PCBs 210*a* and 210*b* are preferably made out of transparent material so that the sensors 220*a* and 220*b* can sense the pattern of contacts on the flexible PCBs 216*a* and 216*b*.

Figure 5:
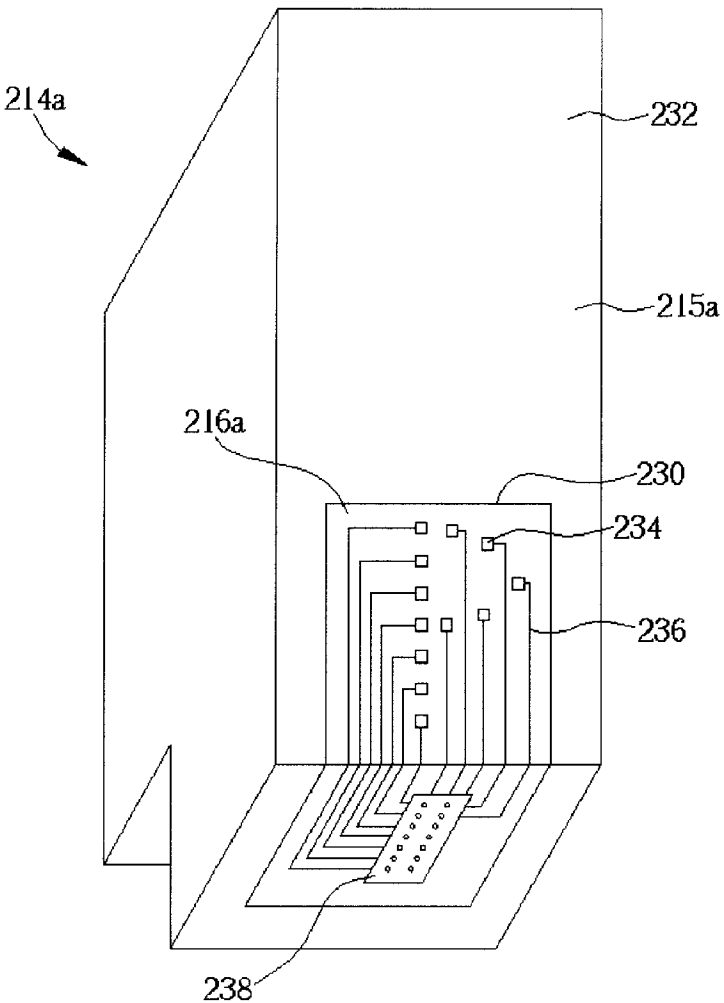
FIG. 5 is a perspective view of the inkjet cartridge according to the present invention.

Please refer to FIG. 5. FIG. 5 is a perspective view of the inkjet cartridge 214*a* according to the present invention. For convenience, the inkjet cartridge 214*a* is used as an example of all inkjet cartridges used in the present invention, and is also representative of the inkjet cartridge 214*b*. The inkjet cartridge 214*a* has an ink reservoir 232 for holding ink of at least one color. Depending on the type of inkjet cartridge 214*a* being used, there may also be three or more ink reservoirs 232 for holding different colors of ink. The inkjet cartridge 214*a* also contains a tape automated bonding (TAB) device 230 formed on the surface 215*a* of the inkjet cartridge 214*a*. The TAB 230 contains the flexible PCB 216*a*, a printhead 238 formed on the flexible PCB 216*a*, a plurality of contacts 234 formed on the flexible PCB 216*a* for contacting with the PCB 210*a* of the carriage 202, and a plurality of conductive traces 236 for connecting each of the contacts 234 to the printhead 238.

As can be seen in FIG. 5, the contacts 234 on the TAB 230 are arranged to form the shape of the letter "P". The contacts 234 are used as an identifiable area of the inkjet cartridge 214*a*. The contacts 234 in the identifiable area can be arranged into the shape of a trademark, a brand name, or a pattern that indicates the color of ink stored in the inkjet cartridge 214*a*. For instance, the letter "P" can indicate that the inkjet cartridge 214*a* is a photo cartridge. As shown in FIG. 5, the TAB 230 is disposed on the front surface and the bottom surface of the inkjet cartridge 214*a*.

Figure 6:
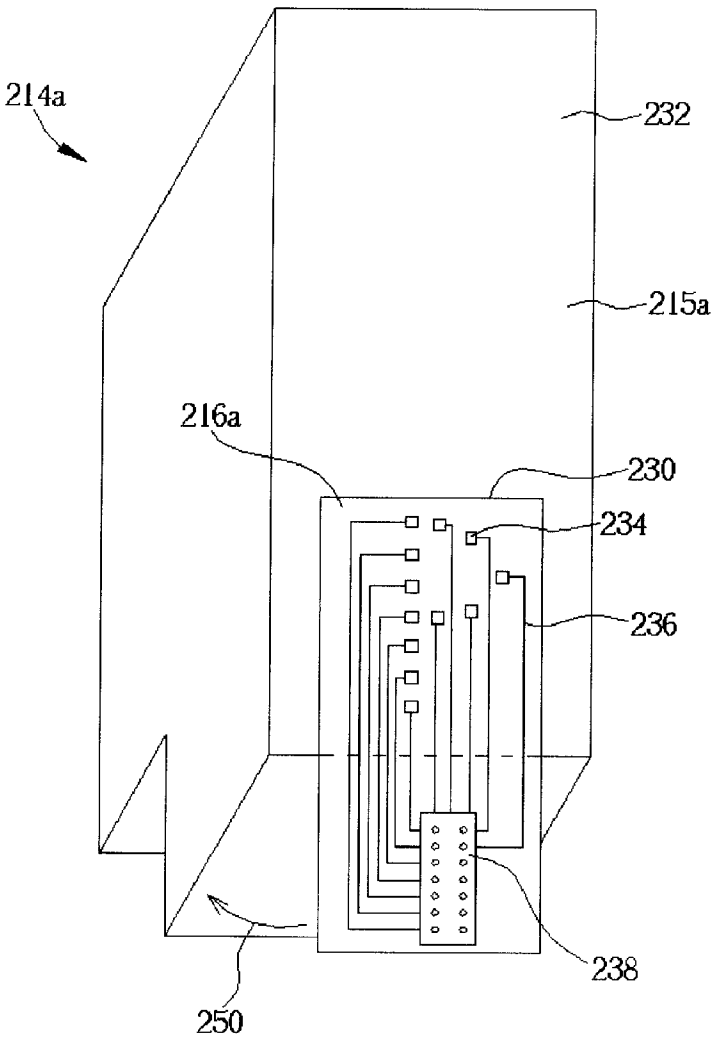
FIG. 6 illustrates a perspective diagram of the inkjet cartridge in which the TAB is not folded.

Please refer to FIG. 6. FIG. 6 illustrates a perspective diagram of the inkjet cartridge 214*a* in which the TAB 230 is not folded. The lower end of the TAB 230 can be bent inwards along the direction of arrow 250 to attach the lower end of the TAB 230 to the bottom surface of the inkjet cartridge 214*a*.

Figure 7:
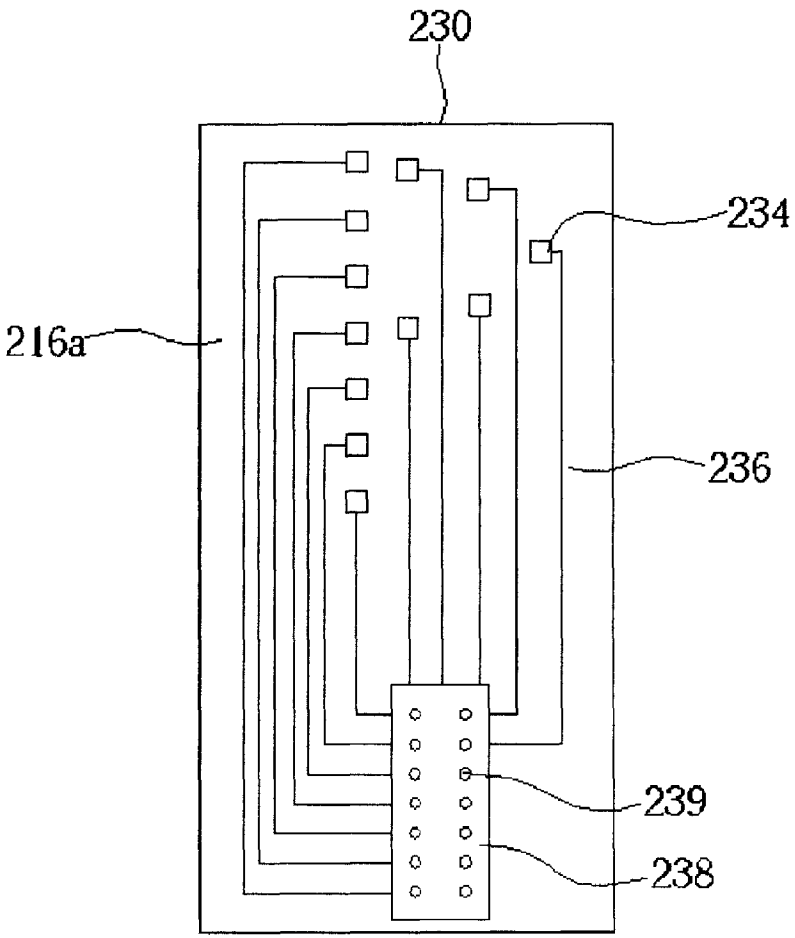
FIG. 7 and FIG. 8 show examples of creating an identifiable area using contacts of the TAB.
Figure 8:
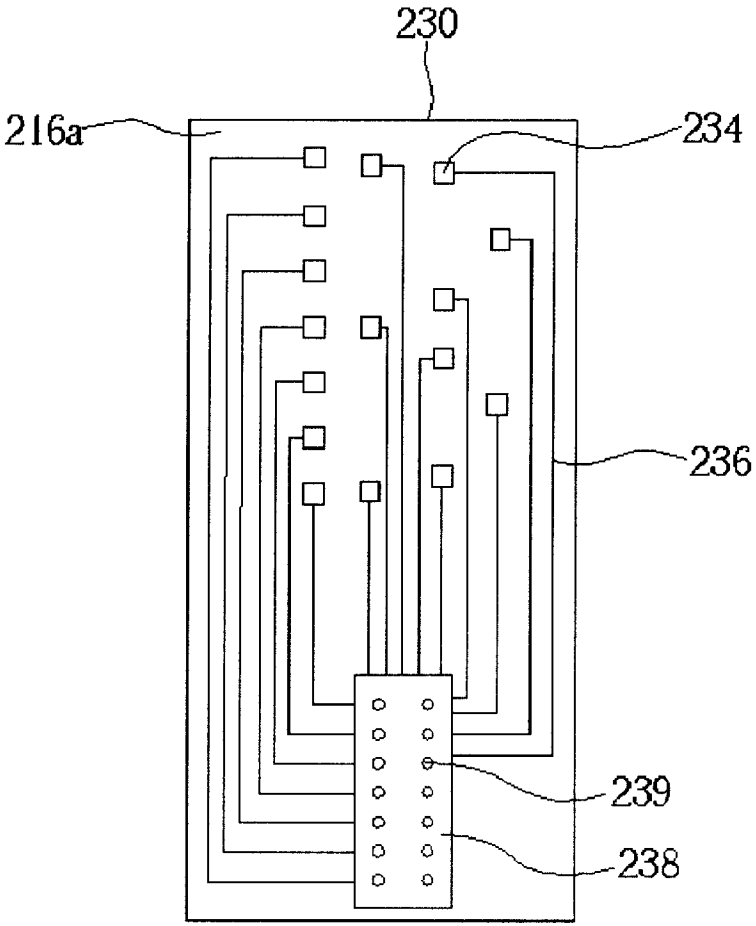

Please refer to FIG. 7 and FIG. 8. FIG. 7 and FIG. 8 show examples of creating an identifiable area using contacts 234 of the TAB 230. Like FIG. 6, the TABs 230 shown in FIG. 7 and FIG. 8 are not folded. The contacts 234 on the TAB 230 shown in FIG. 7 are arranged to form the letter "P".

Likewise, the contacts 234 on the TAB 230 shown in FIG. 8 are arranged to form the letter "B". There are numerous ways to represent the colors of ink used in the inkjet cartridge 214*a*. The following lists some example codes for indicating the color of ink in the inkjet cartridge 214*a*: "Cl" for a color cartridge, "B" or "Bk" for black, "P" or "Ph" for a photo cartridge. In addition, "C", "M", "Y", "c", and "m" can be used to identify cyan, magenta, yellow, light cyan, and light magenta, respectively. The printhead 238 contains a plurality of nozzles 239 for ejecting the colored ink from the inkjet cartridge 214*a*.

Figure 9:
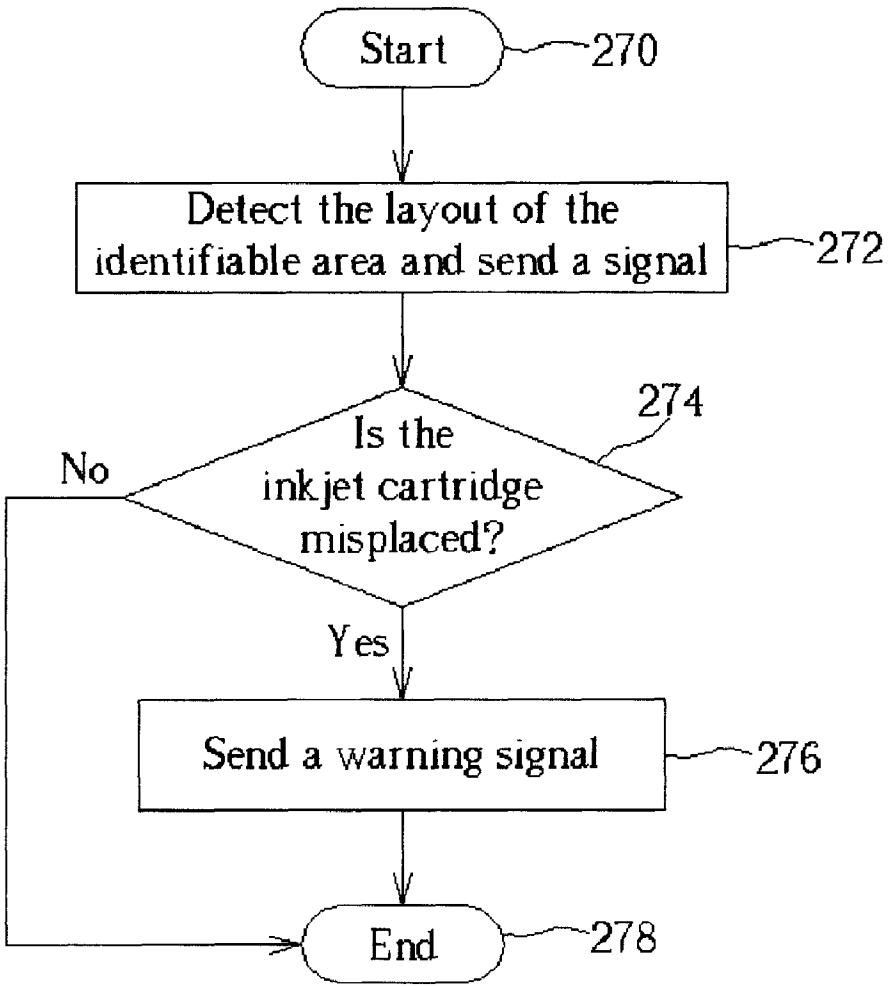
FIG. 9 is a flowchart representing a method of preventing the misplacement of inkjet cartridges according to the present invention.

Please refer to FIG. 9. FIG. 9 is a flowchart representing a method of preventing the misplacement of inkjet cartridges according to the present invention. Steps contained in the flowchart will be explained below.

Step 270: Start;

Step 272: The sensors 220*a* and 220*b* respectively detect the identifiable areas of the inkjet cartridges 214*a* and 214*b*. The sensors 220*a* and 220*b* detect the pattern of the contacts 234 and the conductive traces 236 on the TABs 230 of the inkjet cartridges 214*a* and 214*b*, and send a first signal and a second signal to the control unit 225;

Step 274: The control unit 225 receives the first and the second signals from the sensors 220*a* and 220*b*, and determines whether the inkjet cartridges 214*a* and 214*b* are placed in the correct positions. If the control unit 225 determines that the inkjet cartridges 214*a* and 214*b* are placed in the correct positions, the printing operation is allowed to proceed and the process ends in step 278; otherwise, the flow proceeds to step 276;

Step 276: When the inkjet cartridges 214*a* and 214*b* are misplaced at the slots 212*b* and 212*a*, the control unit 225 sends a warning signal like a sound or a sign to alert the user. After noticing the warning signal, the user has a chance to switch or change the inkjet cartridges 214*a* and 214*b*; and Step 278: End.

In summary, the present invention proposes inkjet cartridges with an identifiable TAB. Users of an inkjet apparatus can easily and quickly distinguish between the different types of inkjet cartridges by looking at the identifiable TABs. The present invention is suited for use in inkjet cartridges used in any inkjet apparatus, such as a copy machine, a facsimile machine, or an inkjet printer. Moreover, even if the user still inserts the inkjet cartridge into the wrong slot in the inkjet apparatus, the inkjet apparatus can produce alert the user to the misplaced condition.

Those skilled in the art will readily appreciate that numerous modifications and alterations of the device may be made without departing from the scope of the present invention. Accordingly, the above disclosure should be construed as limited only by the metes and bounds of the appended claims.

What is claimed is:

1. An identifiable TAB disposed on an inkjet cartridge, comprising:

a flexible substrate;

a plurality of conductive traces formed on the flexible substrate; and a plurality of contacts formed on the flexible substrate and connected to the conductive traces;

wherein the contacts are arranged into at least one identifiable area for indicating a trademark or a brand name.

2. An inkjet print cartridge, comprising:

a casing having an ink reservoir for containing N types of ink, each type of ink having a different color, wherein N is an integer; and a TAB assembled to the casing, comprising:

a flexible substrate;

a plurality of conductive traces formed on the flexible substrate; and a plurality of contacts formed on the flexible substrate and connected to the conductive traces, wherein the contacts are arranged into N types of identifiable areas, wherein the identifiable areas are contain text for indicating the colors of ink in the ink reservoir.

3. The inkjet print cartridge according to claim 2, wherein N equals 1.

4. The inkjet print cartridge according to claim 2, wherein N equals 3.

5. A method of identifying the colors of ink contained in an inkjet cartridge by an identifiable TAB, comprising the steps of:

providing at least one inkjet cartridge, the inkjet cartridge comprising:

a casing having an ink reservoir for containing N types of ink with different colors, wherein N is an integer; and an identifiable TAB disposed to the casing, the TAB comprising:

a flexible substrate;

a plurality of conductive traces formed on the flexible substrate; and a plurality of contacts formed on the flexible substrate and connected to the conductive traces, wherein the contacts are arranged into N types of identifiable areas; and identifying at least N types of ink in the ink reservoir, wherein N types of ink have different colors, and the identifiable areas contain text for indicating the colors of ink.

6. The method according to claim 5, wherein N equals 1.

7. The method according to claim 5, wherein N equals 3.

8. The method according to claim 5, wherein the colors of ink are selected from the group consisting of black, cyan, magenta, yellow, light black, light cyan, light magenta, light yellow, orange, green, light orange, and light green.

9. An inkjet apparatus, comprising:

a carriage equipped with a flexible circuit board (FCB);

a first flexible TAB and a second flexible TAB respectively disposed in a first inkjet cartridge and a second inkjet cartridge electrically coupling to the FCB on the carriage, the first inkjet cartridge and the second inkjet cartridge respectively having a first plurality of contacts and a second plurality of contacts, wherein the first contacts and the second contacts are arranged into a first identifiable area and a second identifiable area, wherein the first identifiable area and the second identifiable area contain text for indicating the colors of ink stored in the first inkjet cartridge and the second inkjet cartridge;

a first sensor, disposed in the carriage for detecting the first identifiable area and sending a first signal;

a second sensor, disposed in the carriage for detecting the second identifiable area and sending a second signal; and a control unit for receiving the first signal and the second signal, and determining whether the first inkjet cartridge and the second inkjet cartridge are correctly placed.

10. The inkjet apparatus according to claim 9, wherein the control unit sends a warning signal to alert a user when the first inkjet cartridge or the second inkjet cartridge is misplaced.

11. The inkjet apparatus according to claim 9, wherein the carriage is equipped with a first FCB and a second FCB, wherein the first FCB and the second FCB are electrically coupled to the first flexible TAB of the first inkjet cartridge and the second flexible TAB of the second inkjet cartridge, respectively.

12. The inkjet apparatus according to claim 11, wherein the first sensor and the second sensor are positioned at the first TAB and the second TAB, respectively.

13. The inkjet apparatus according to claim 9, further comprising a housing, wherein the first sensor and the second sensor are disposed in an inside wall of the housing.

14. The inkjet apparatus according to claim 9, wherein the first identifiable area and the second identifiable area are formed at the first flexible TAB of the first inkjet cartridge and the second flexible TAB of the second inkjet cartridge, respectively.

15. The inkjet apparatus according to claim 9, wherein the first inkjet cartridge has a first surface and the second inkjet cartridge has a second surface, and the first identifiable area and the second identifiable area are located at the first surface and the second surface, respectively.

16. The inkjet apparatus according to claim 9, wherein the first signal and the second signal are wirelessly transmitted between the control unit, the first sensor and the second sensor.

* * * * *